US005275105A

United States Patent [19]

Schweizer et al.

[11] Patent Number: 5,275,105

[45] Date of Patent: Jan. 4, 1994

[54] ROTARY PRINTING MACHINE EQUIPPED WITH AN EXCHANGEABLE CYLINDER

[75] Inventors: Martin Schweizer, Lausanne; Charles Stark, Prilly, both of Switzerland

[73] Assignee: Bobst SA, Switzerland

[21] Appl. No.: 864,542

[22] Filed: Apr. 7, 1992

[30] Foreign Application Priority Data

Apr. 9, 1991 [CH] Switzerland ..... 01047/91

[51] Int. Cl.[5] ..... B41F 13/34

[52] U.S. Cl. ..... 101/477; 101/216; 414/341

[58] Field of Search ..... 101/216, 477; 414/341

[56] References Cited

U.S. PATENT DOCUMENTS

| | | | |
|---|---|---|---|
| 3,039,387 | 6/1962 | Zimmer et al. | 101/216 |
| 3,173,360 | 3/1965 | Hamilton | 101/216 |
| 3,173,361 | 3/1965 | Verlik | 101/216 |
| 3,625,145 | 12/1971 | Heatley | 101/216 |
| 3,730,080 | 5/1973 | Deligt | 101/216 |
| 3,789,757 | 2/1974 | Motter et al. | 101/153 |
| 3,876,087 | 4/1975 | Osta | 101/216 |
| 4,046,070 | 9/1977 | Halley | 101/216 |
| 4,449,450 | 5/1984 | Barny | 101/216 |
| 4,502,384 | 3/1985 | Habluetzel | 101/216 |
| 4,901,641 | 2/1990 | Steiner et al. | 101/216 |
| 4,913,048 | 4/1990 | Tittgemeyer | 101/216 |
| 4,971,508 | 11/1990 | Miyahara et al. | 414/341 |
| 5,074,207 | 12/1991 | Lübke et al. | 101/216 |

FOREIGN PATENT DOCUMENTS

| | | |
|---|---|---|
| 0315917 | 11/1988 | European Pat. Off. . |
| 697501 | 10/1940 | Fed. Rep. of Germany . . |
| 503628 | 3/1920 | France . |
| 2186889 | 1/1974 | France . |
| 2503628 | 10/1982 | France . |
| WO87/04665 | 8/1987 | PCT Int'l Appl. . |

*Primary Examiner*—Edgar S. Burr
*Assistant Examiner*—John S. Hilten
*Attorney, Agent, or Firm*—Hill, Steadman & Simpson

[57] ABSTRACT

A rotatable printing machine includes a horizontal exchangeable cylinder which is held between two sidewalls of a machine frame by a holding and driving arrangement which enables disengagement. To remove the cylinder, a carriage arrangement is positioned in the frame and can include a movable trolley for receiving the cylinder and sliding it in a horizontal plane onto a hand cart. One embodiment includes a movable table for raising and lowering the cylinder from the path of the trolley to the operating position. Another embodiment positions rails for the trolley immediately underneath the operating position of the cylinder and includes an arrangement for raising and lowering supports for the cylinder relative to the cylinder. A third embodiment includes a fixed track mounted immediately adjacent the cylinder and utilizing position adjustment means for the drives of the cylinder to lower the cylinder onto the track.

14 Claims, 4 Drawing Sheets

ROTARY PRINTING MACHINE EQUIPPED WITH AN EXCHANGEABLE CYLINDER

BACKGROUND OF THE INVENTION

The present invention is directed to a rotary printing machine which is equipped with an interchangeable cylinder, especially a screen ink transfer cylinder, which is also called "anilox" cylinder and is held between two side walls of the machine frame by a freely disengageable holding and driving means.

With a view to optimize the use of the rotary printing machine, exchangeable anilox or transfer cylinders have become a more desirable feature.

In fact, depending on the given print motif, for example a very intensive solid requiring considerable ink quantities or a fine meshed screen necessitating much less ink, it is possible to vary the quantity of ink being transferred by either varying the viscosity of the ink by dilution or to exchange the anilox or transfer cylinder of which the volume of the bits on the cylinder surface will determine the quantity of ink being transferred. Considering the difficulties to master the ink homogeneity and viscosity, an increasingly preferable solution consists in exchanging the anilox or transfer cylinders.

Patent Documents FR 2 503 628; WO-87/04665 and EP-315 917 present rotary printing machines equipped with one or several cylinders and the driving means lodged in a so-called cassette. The cassette can be removed horizontally from the machine perpendicularly to the lateral or side wall of the machine. As may be gathered, the weight of the exchangeable assembly of the cassette comprises the weight of the cylinders to be exchanged must also include the weight of the cassette body, as well as the cylinder holding and driving means, which are attached thereto. Handling of such an assembly will, thus, be so difficult that the exchange will not be carried out as often as it should.

U.S. Pat. No. 4,901,641, whose disclosure is incorporated herein by reference thereto, discloses a rotary printing machine. In this Patent, a printing cylinder is held by two axles which have tapered or frusto-conical ends which extend into equally tapered apertures arranged coaxially on both lateral ends of the cylinder. The axle may be freely advanced or retracted, as required, toward and from the cylinder in order to seize the cylinder or to disengage it. Moreover, an ink basin is kept underneath the printing cylinder by a bracket arrangement, which can be rotated around a vertical threaded shaft and also descend along the threaded shaft. The linkage between the basin and the bracket is also rotatably movable. The inner surface of the basin is provided with a V-shaped, half-rigid support for the cylinder.

With the bracket rising, the basin will come into contact with the lower surface of a cylinder and, thus, support its weight. The cylinder holding axles will then be retracted to release the cylinder and, by a double rotation of the basin with regard to the bracket as well as the bracket with regard to the threaded shaft, it will be possible to disengage the printing cylinder through an upstream side of the printing device and then across one of the side walls. It becomes obvious that the bracket holding the cylinder at the very end of the basin and the cylinder should be particularly well-dimensioned and that the movement to be carried out for the release of the cylinder is rather complex for less qualified workers.

SUMMARY OF THE INVENTION

The object of the present invention is to provide a rotary printing machine comprising a device for seizing and disengaging an exchangeable cylinder in order to remove it from the machine and to load it on a workshop trolley and to transfer it to another machine and/or to quickly bring along another replaceable cylinder by simple and clear manipulations. Such a device should, of course, be dependable, more especially so not to become the cause of accidents, and without involving the necessity of using overdimensioned, heavy and expensive parts.

To accomplish these goals, they are obtained by an improvement in a rotary printing machine having an exchangeable cylinder held between the two side walls of the machine frame by holding and driving means which are disengageable, as required. The machine will have built-in means in a vertical plane crossing the cylinder which will allow, first, the vertical shifting of the cylinder held in a horizontal position and expected to be transferred onto a carriage situated at a height allowing to take the cylinder out of the printing machine frame by moving it along a horizontal plane perpendicular to the lengthwise axis of the cylinder.

On the basis of this definition, the removal of the cylinder from the machine essentially consists of two shiftings; a first one along a vertical cylinder plane allowing the cylinder to be laid onto the carriage, and a second one effected by the carriage taking the cylinder out of the machine through a downstream or upstream side. The means situated within the machine and ensuring the first shifting improve the stability and optimize the use of the space, due to the simplified design.

It should be advantageous to equip the carriage with two rails fitted opposite one another directed either against the inner opposite sides of the side walls of the frame or else fitted on the frame crossbars. On these rails would run two identical end members of a trolley which members are provided on their upper surfaces with at least one cylinder support. The end members are held together at their end on one side by a rigid connection enabling to keep a free space in the carriage center. It would be useful to add to one of the carriage rails a rack, and to the corresponding end members of the trolley a device with guides to be actuated by means of a handle so as to have them engage into the teeth of the rack and, thus, to stop the carriage in a precise position.

Explained differently, the carriage may be considered as a frame movable on the rails and supporting the cylinder at both its ends, with the space in the middle being likely to be used for means used to shift the cylinder in a vertical direction.

According to another embodiment of the invention, the means allowing the cylinder to be vertically moved onto the cylinder supports of the trolley include a parallel table underneath the cylinder with a length less than the distance between the end members of the trolley and provided with cylinder supports on its upper surface. This table is shifted vertically by lifting means between the upper position against the lower part of the cylinder and a lower position situated below the position of the trolleys with the table passing through the space available in the center of the carriage.

The lifting means of the table may essentially consist of two brackets or arms arranged to form an X and joined in their centers with their ends rotatably movable, at least one of the ends below the ground level and one of the upper ends below the table are, additionally, movable sidewise and parallel to the table. An actuator checks the position either of the ends movable in the upper sidewise direction or the ends movable in the lower sidewise direction. Preferably, only the ends of the brackets situated on one side, i.e., upper and lower ones, are shiftable sidewise and the actuator is fitted onto the ground level and engages the end slidably along the ground level.

Alternatively, the lifting means of the table include one or several vertical actuators that are positioned therebeneath. If, with the design thus realized, the table once retracted is fully on the ground level under the carriage and the device for disengaging the cylinder will in no way be able to interfere with the operation of the printing machine.

It would be advantageous to design a workshop trolley or cart with its own carriage rails situated at an identical height and with identical spacing as the machine carriage rails. Such a cart, moreover, includes positioning means allowing to fix it with regard to the upstream or downstream side of the frame in such a way that the rails will be situated as extensions of the machine's rails. Such a cart might also include a carriage or trolley provided with a space in its center, as described above.

According to another one of the embodiments of the invention, the trolley resting on horizontal rails is fitted close to and underneath the cylinder. The means used for the vertical shifting or lifting of the cylinder include, then, one or several supports fitted so as to be able to be rotated on a vertical threaded rod engaged in threaded holes of the upper side of the corresponding trolley. Alternatively, one or several of the cylinder supports can be raised and lowered, as required by a vertical actuator.

According to another way of realizing the invention, the carriage includes two stays or members situated each facing, and close to, the inner opposite sides of the side walls of the frame and fitted on crossbars, every stay bearing in the region of and underneath the cylinder a horizontal bar protruding from the frame, with each end provided with a stopping plate. Both of these bars are held one with regard to the other by at least one horizontal crossbar. The means for the vertical shifting of the cylinder consists of a jack-type device raising and lowering the cylinder holding and driving means.

These simplified versions are actually foreseen for occasional fitting and dismantling so as to allow the withdrawal of the cylinder for repair and cleaning. In such a case, the horizontal carriage is preferably mounted closely adjacent the cylinder, which solution allows the dispensing with the table of the lifting means by using raising and lowering of the cylinder supports covering a short distance, or else a device raising and lowering the holding and driving means of the cylinders equally through a short distance.

If the interchangeable cylinder is held and driven by two taper-end pieces fitted for rotary motion, which face the side walls and engage in the axial tapered orifices of the corresponding cylinder sides, one of the pieces being rotatable and the other one allowed to be withdrawn, as required so as to disengage the cylinder, it appears to be appropriate to have every lateral end of the exchangeable cylinders provided with a concentric rim having an inner circumferential surface which has a tapered configuration tapering outward as the rim extends toward the outer end of the cylinder. The cylinder holding drive pieces having the shape of tapered disks having tapered circumferential surfaces with the largest diameter exceeding the smallest inner diameter of the corresponding rim. As a useful feature, one of the disks includes a concentric pusher held against a corresponding end wall of the cylinder so as to disengage the end rim from the disk, with the opposite disk being in a retracted position.

As will be easily understood, the contact surface between the driving piece and the cylinder side corresponds to the circumference of the disk with a larger diameter. This contact surface can, thus, be reduced and, thereby, enable an easier disengagement.

Other advantages and features of the invention will be readily apparent from the following description of the preferred embodiments, the drawings and claims.

DESCRIPTION OF THE PREFERRED EMBODIMENTS

Figure 1:
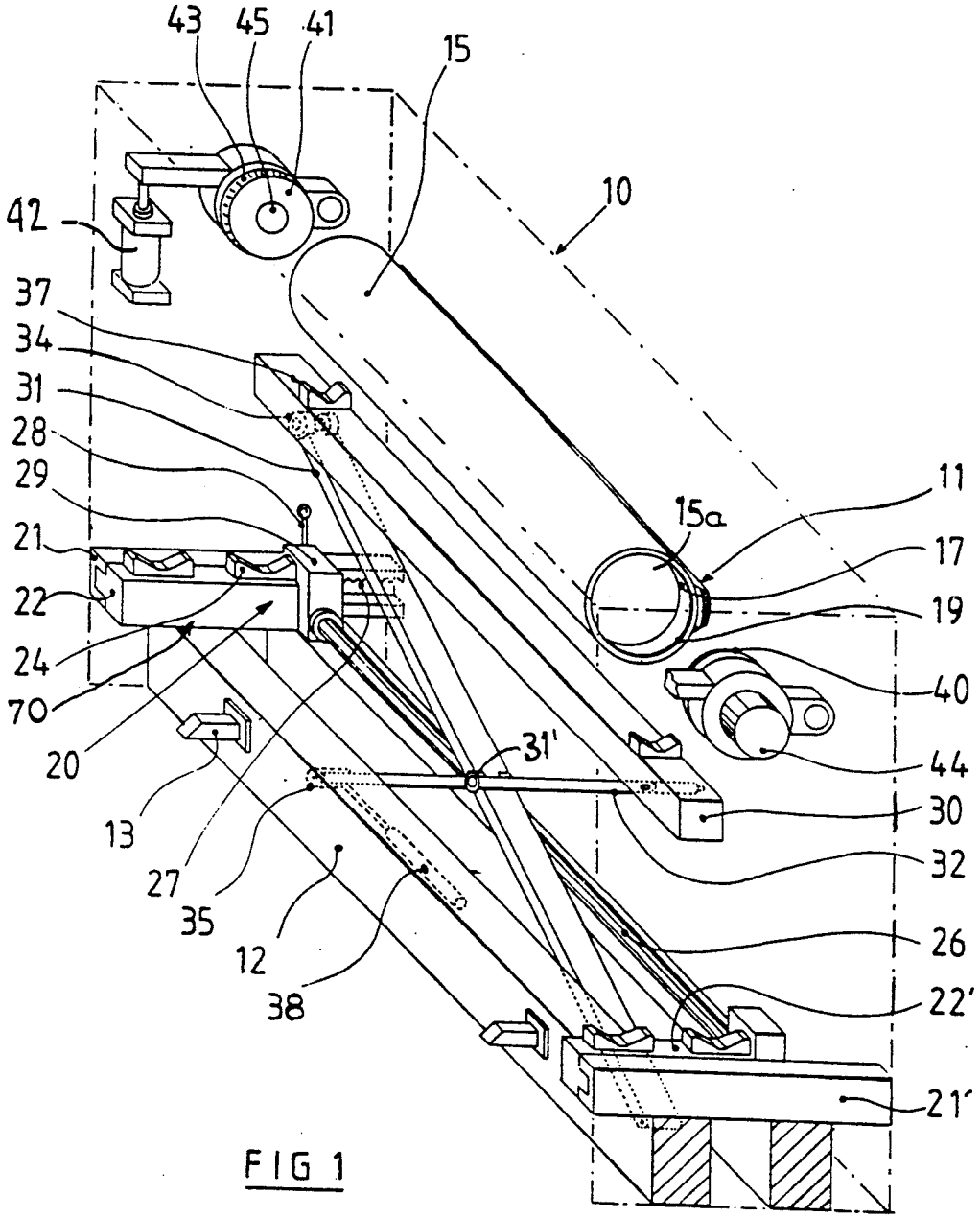
FIG. 1 is a schematic perspective view of a printing device containing a first embodiment of the device for disengaging and exchanging a cylinder with portions removed for purposes of illustration.

The principles of the present invention are particularly useful when incorporated in a rotary printing machine having a frame, generally indicated at 10 in FIG. 1. The frame 10 is only shown in dotted lines and the cylinder situated above an anilox or transfer cylinder 15, such as a plate cylinder, and the impression rollers are not represented, but can be similar to those in the above-mentioned U.S. Pat. No. 4,901,641. It also should be pointed out, for purposes of illustration, the exchangeable cylinder 15 is represented with a shorter shape than in reality so as to allow the maintenance and drive means to be shown in more obvious ways. In the printing machine, the inking device will consist essentially of a lengthwise chamber 11, which is applied against the cylinder 15. Ink is circulated in the chamber 11 before being scraped off the cylinder by an upper and lower blade attached to the chamber 11.

Both ends of the cylinder 15 are extended by a rim 17 from the end wall, such as 15*a*. Each of the rims 17 have the same outer diameter as the cylinder itself and have an inner circumferential surface which is shaped with a taper 19, which tapers with a converging taper as it approaches the end wall, such as 15*a*. This tapered part or surface 19 can be realized, for instance, with the shape of a chamfer on the inner circumferential surface. The cylinder 15 is held between two disks 40 and 41, which have circumferential surfaces 43, which are also tapered and directed with the taper converging to the surface of the disk that is closest to the ends of the cylinder. The disks 40 and 41 are mounted for free rotation on each side of the frame 10 with, if necessary, a jack-type device 42 (only shown for the disk 41) so as to allow the cylinder 15 to be slightly raised or lowered against a printing cylinder, which is not represented in the drawings. The installation for mounting the disk 40 also includes a device 44 with a hydraulic or pneumatic jack which enables the disk 40 to be moved toward or away from the respective end of the cylinder 15 between an engaging position and a retracted position. In this manner, if the device 44 is actuated, it is possible to insert the tapered circumferences 43 of the disks 40 and 41, as required, into the equally tapered parts 19 of the ends of the cylinder 15 so as to simultaneously seize, center and rotate the cylinder owing to the considerable frictional force appearing at the tapered contact junction. The disk 41, in its axial center, includes a pusher 45, which may be formed by an inner coaxial position, with the outer surface being visible in FIG. 1. This pusher 45 can be moved forward by an inner actuator (not illustrated) to engage a corresponding end member or wall of the exchangeable cylinder 15.

A device for disengaging the cylinder 15 includes a vertically movable table 30 and a horizontal carriage means 20. As illustrated, the table 30 is provided on its upper surface with several cylinder supports 37. The table 30 is held by two brackets or arms 31 and 32, which are pivoted together at point 31' to form an X-wise arrangement. The upper end of the arm 32 is pivotably connected to the table 30 at the end in the foreground of FIG. 1. Similarly, the lower end of the arm 31, equally shown in the foreground of FIG. 1, is pivotably connected at the ground level to frame elements, such as crossbars 12. The upper end of the arm 31 is both movable rotatably and sidewise underneath the table 30, due to a caster 34 engaging a lower surface. In a similar manner, the lower end of the arm 32, represented in the background of FIG. 1, is movable both rotatably and sidewise along the ground level, owing to the caster 35. The position of the lower end of the bracket or arm 32 is determined by an actuator 38, which may be a double-acting piston, and will impose vertically the height of the table 30 by the kinematics of the crossed arms. The actuator 38 may, indifferently, be a hydraulic or a pneumatic jack, or even a threaded rod rotatably movable driven by an electric motor and passing through a tapped orifice arranged in the lower part of the arm 32. When in its retracted position, the table 30 will be positioned between the two crossbars 12 of the frame 10.

The carriage means, generally indicated at 20, includes two rails 21 and 21', which are mounted close to the ground level opposite one another and against the side of the frame 10. Preferably, the rails 21 and 21' are supported by the crossbars 12 on the ground level. The rail 21 guides an end member 22 of a trolley, generally indicated at 70, and is provided on its upper surface with two cylinder supports 24. In a similar manner, the rail 21' guides an end member 22', which also has two cylinder supports. The two end members 20 and 21' are rigidly held together at one end by a rod 26 to ensure a rigorous correspondence between the cylinder supports 24 of the member 22 placed opposite one another and to, thus, form a trolley 70. As may be noticed better in the rail 21, it is provided with a rack 27, the teeth of which can be engaged by a dog belonging to a locking device 29, which has an actuating handle 28.

Figure 2:
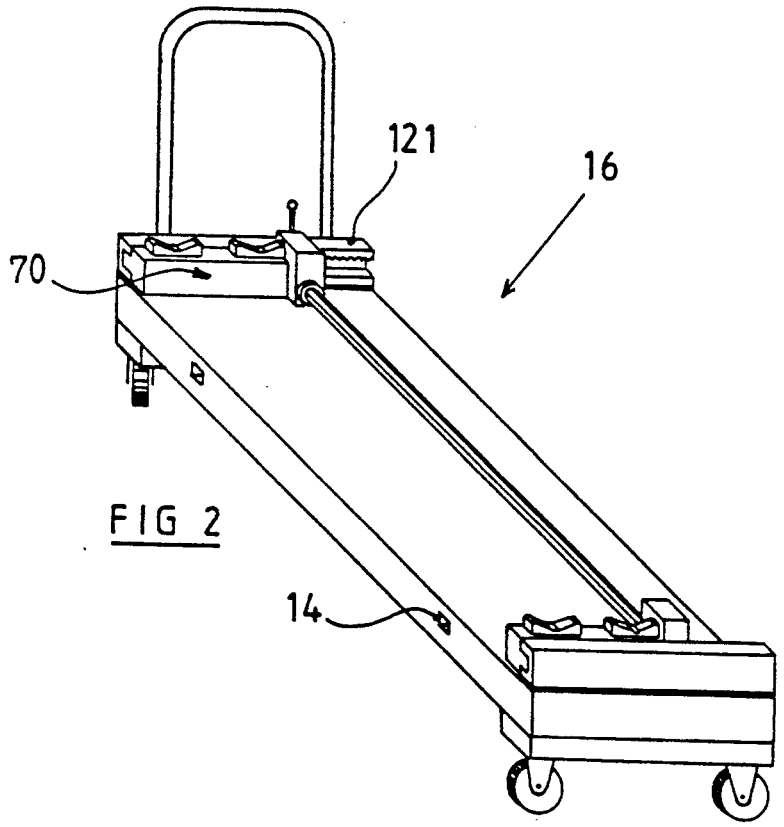
FIG. 2 is a schematic perspective view of a workshop cart, preferably used for the machine of FIG. 1.

A workshop trolley or hand cart 16 is illustrated in FIG. 2 and is constructed for carrying one or several cylinders 15 from one printing machine to another. As a particular feature, the upper surface of this cart is provided with a trolley 70 identical to the one described previously and mounted on two rails 121. Moreover, the longitudinal sides of the cart 16 have two apertures 14 which will coact with bolts or protrusions 13 mounted on the crossbar 12 of the frame 10 of the machine of FIG. 1 to form means for positioning the cart 16 along an upstream side of the frame 10 in such a way as to enable the rails 121 to be situated as extensions of the machine rails 21, 21'. In this way, the machine trolley 70 can be rolled on and off the cart 16.

At an end of the rail 21 of the frame 10, safety devices are foreseen for the purpose of stopping the trolley 70 of the carriage means 20 at the outlet of the frame 10 if a workshop cart 16 is not appropriately positioned, for example if the positioning means 13 and 14 are not engaged with one another.

As already described, the machine operates in the following way. With the cylinder 15 being initially held between the two disks 40 and 41, the operator is to order the retraction of the actuator 38, which action will cause a rising of the table 30 until the supports 37 touch the lower part or surface of the cylinder 15. The device 44 is then switched on so that the disk 40 will be pulled out of the rim 17 at that end of the cylinder 15. In most cases, the cylinder will, nonetheless, not be disengaged from the disk 41. Thus, the pusher 45 will have to be actuated so as to engage the end member or wall of the cylinder to move or slightly shift the cylinder 15 axially until the tapered circumferential surface 43 of the disk 41 will come out of the rim 17.

As soon as the cylinder 15 is disengaged from the holding and driving means 40 and 41, the operator is able to order the actuation of the actuator 38, which action will cause the lowering of the table 30 until the latter will move into the center of the trolley 70. At this stage, the ends of the cylinder 15 will be engaged by the supports 24 of the end members 22 and 22' of the trolley 70, whereas the table 30 continues its movement to the full retracted position between the crossbars 12. The cylinder 15, resting now on the trolley 70, can be shifted in a direction perpendicular to the axis of the cylinder along the rails 21, 21'. In line with the first possibility, the carriage has, on its upper surface, at least two pairs of supports 24, the second pair being already used for carrying a second anilox cylinder 15, which is desired. In such a case, the simple shifting of the trolley 70 allows the movement of the second cylinder into the desired position above the table 30, which is still in the retracted position. The trolley is then interlocked in this position by the end stop device 29. Hence, only a new raising of the table 30 is to be ordered so as to lift the new cylinder 15 until it is opposite the holding and drive disks 40 and 41. Then, the actuator 44 will be actuated to cause the disks to engage and seize the cylinder.

With a second possibility, an empty workshop trolley or cart 16 is previously placed and fixed along the upstream side of the frame 10. Thereupon, the trolley 70 carrying the cylinder 15 is rolled from the rails 21, 21' of the frame 10 onto the rails 121 of the cart 16 to enable the cylinder to be carried out of the machine for subsequent operation. Then, by means of another cart 16, a new cylinder is brought on site and put into the lower part of the printing machine.

Figure 3:
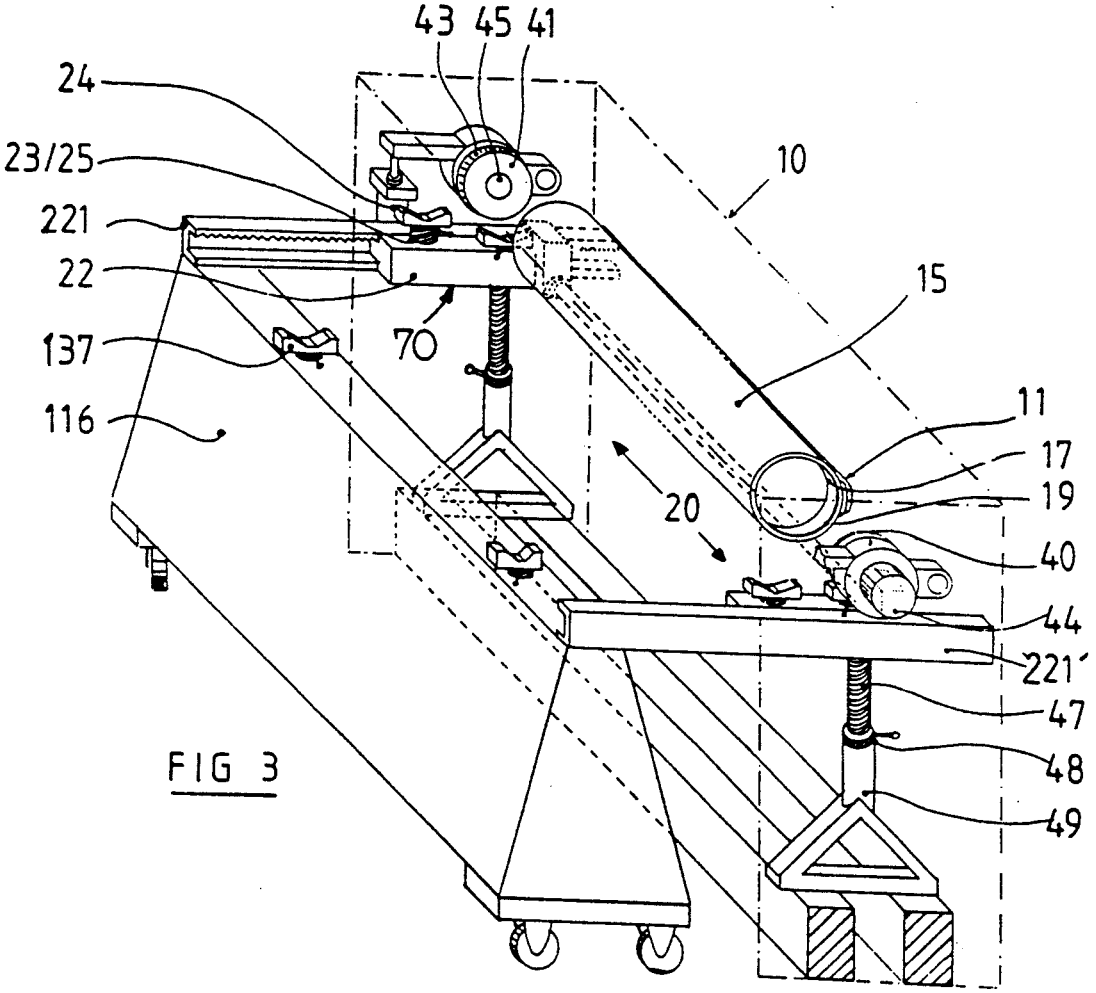
FIG. 3 is a perspective view of a printing machine provided with a second embodiment of a device for disengaging and exchanging a cylinder which is removed occasionally and laid on a conventional workshop cart.

In FIG. 3, a printing machine from which the anilox cylinder or transfer cylinder 15 is only supposed to be withdrawn for cleaning or repair is illustrated. Parts in this Figure, which are similar or the same as parts in the previous embodiment are identified with the same reference numbers. In this case, the carriage means 20 is mounted and disassembled, with the action being accomplished higher up and closer to the cylinder 15 and, thus, allows the dispensing of the automatic table 30 previously described. As represented by the illustration, two rails 221 and 221', which are similar to the rails 21 and 21' but of a greater length, are positioned opposite one another close to and parallel with each side of the frame 10. Every rail 221 and 221' rests on a conventional workshop trolley or hand cart 116, as well as on a support 49, which enables the adjustment of the height of the rail to a certain extent. According to the illustration, the support 49 includes a threaded rod 47 held within a threaded bushing 48 so that rotation of the rod in the bushing will either raise or lower the rail, such as 221'.

The trolley 70 movable on the rails 221 and 221' is initially shifted so as to allow a pair of supports 24 to be positioned under the anilox cylinder 15. Owing to the actuator formed by the threaded rods 47 acting immediately beneath the rails 221 and 221', the entire carriage can be raised as far as to allow the supports 24 to support the cylinder 15, which can then be disengaged from the holding and driving means 40 and 41 in the manner previously described.

With the anilox or transfer cylinder 15 disengaged, the trolley 70 is slowly rolled or shifted along the two rails 221 and 221' to place it above supports 137 of a workshop trolley or cart 116. The supports 137 are also mounted on actuators, such as threaded rods which pass through a threaded sleeve, and these threaded rods can be turned by a handle. Turning the rods causes the supports 137 to rise in such a way as to seize the cylinder 115 and to lift it sufficiently to disengage it from the support 24 of the trolley 70 and enable the trolley 70 to be withdrawn.

Alternatively, the carriage supports 49 may be fixed or else substituted by case piles and then support elements 24 of the end member 22 of the trolley 70 are fitted for free rotation on threaded vertical rods 25, which are received in threaded openings 23 on the upper side of the member 22 forming the trolley 70. Hence, the cylinder is then seized not by the rising of the entire trolley 70, but by the rising of each of the support elements 24 with regard to the trolley.

Figure 4:
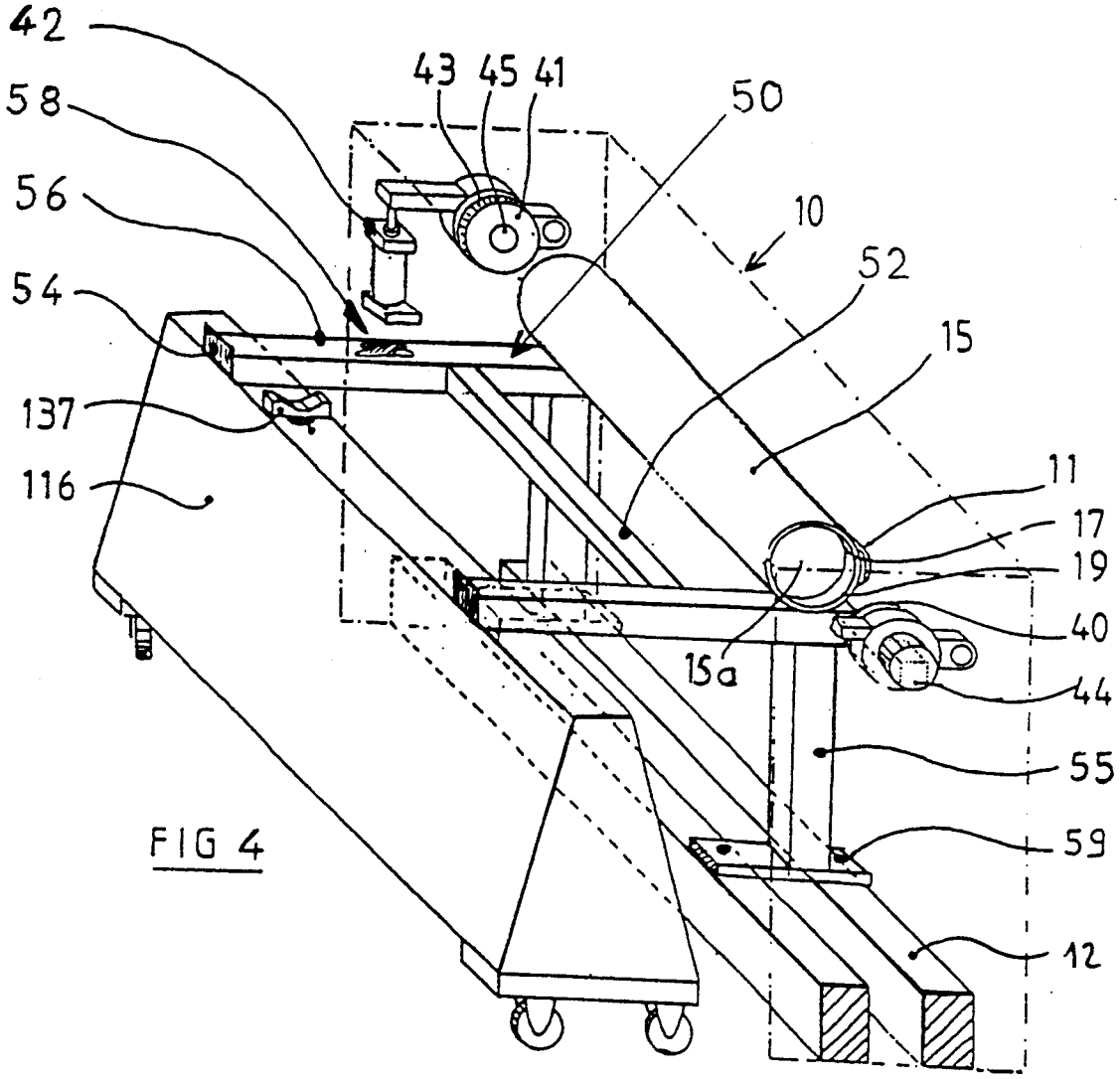
FIG. 4 is a perspective view of a printing machine provided with a third embodiment of a device for disengaging and exchanging cylinders removed occasionally and laid on a conventional workshop trolley.

In FIG. 4, a carriage means 50 consisting of two stays or vertical members 55, which are mounted on the crossbars 12 and secured by means of bolts 59, is illustrated. Every stay or vertical member, on its upper end close to and under the cylinder 15, supports a horizontal bar 56, whose upper surface is provided with a rubber coating 58. Adjacent an end spaced from the position of the cylinder 15, the bar 56 is provided with stop plates 54 at each end. One of the ends of each of these horizontal bars protrudes from the downstream side of the frame. Preferably, both horizontal bars 56 can be held by an intermediate crossbar, such as 52, with regard to one another.

An empty workshop trolley or hand cart 116 is provided on its upper surface with cylinder supports 137, which are fitted on threaded axles, as in the embodiment of FIG. 3. The threaded axles which engage on threaded rings can then be rotated by means of a handle for raising or lowering the supports 137, as required. The trolley or cart is previously moved under the ends of the horizontal bars 56 protruding from the frame. At this stage, the jack, such as 42, which supports the position of the disks 40 and 41, is actuated to lower the disk with the cylinder 15 into a position on the horizontal bars 56, whereupon the device 44 is actuated to withdraw the disk 40 and to disengage the cylinder. As in the previous embodiments, the actuator 45 may be actuated to disengage the cylinder from the disk 41. After this engagement of the cylinder from the disks 40 and 41, the cylinder 15 can be slowly rolled along the bars 56 until it will be stopped by the end plates or stop plates 54. By lifting the supports 137, it will be possible to pick up the disengaged cylinder 15 so that it can be removed with the trolley 116. Another cylinder can then be installed by reversing the steps described hereinabove. If necessary, the carriage means 50 can be dismantled when not in use.

Although various minor modifications may be suggested by those versed in the art, it should be understood that we wish to embody within the scope of the patent granted hereon all such modifications as reasonably and properly come within the scope of our contribution to the art.

We claim:

1. In a rotary printing machine including a frame having a pair of side wall members, an operating axis extending between the pair of side wall members, holding and driving means for disengageably positioning an exchangeable cylinder in the frame of the machine in a cylinder operating position with a cylinder axis coinciding with said operating axis of the machine, the improvement comprising transfer means for moving a cylinder into and out of the frame, said transfer means including carriage means being positioned to transport a cylinder in a substantially horizontal plane in a direction extending perpendicular to the operating axis, said carriage means including a trolley having two end members interconnected at one side of the trolley by a rigid connection to form a center free of structure, said carriage including two rails and means for mounting the two rails in the frame opposite each other and adjacent the two side walls of the machine to extend perpendicular to the operating axis, each of said rails supporting one of said end members of said trolley, each end member of the trolley being provided on an upper surface with a cylinder support element, said transfer means including means to obtain a relative movement in a vertical direction between the cylinder operation position and the trolley to enable engagement of the cylinder while in the operation position by the carriage means and transfer to the cylinder support elements of the trolley with a release of the cylinder by the holding and driving means, said transfer means including a workshop cart positioned at one end of the rails of the carriage means for receiving the cylinder and means for transferring the cylinder from the carriage means to the cart.

2. In a rotary printing machine according to claim 1, wherein the means for obtaining a relative vertical movement includes a parallel table being mounted in the frame of the machine in a vertical plane extending through the operating axis of the cylinder and beneath said cylinder, said parallel table having cylinder supports on an upper surface thereof, said table being supported by lifting means for movement between an upper position with the cylinder supports engaging and supporting a cylinder in the operating position and a lower position with the supports of the table being at a level below the support elements on said trolley.

3. In a rotary printing machine according to claim 2, wherein the lifting means for the table consist essentially of two lever arms pivotably connected adjacent their center, a first of said two lever arms having an end pivotably connected to an underside of the table, a second of said two lever arms having an end movable relative along the under surface of said table, one of said two lever arms having an end pivotably connected to the frame of the machine adjacent a ground level and another of the two arms having an end movable along the ground level.

4. In a rotary printing machine according to claim 3, wherein the first lever arm pivotably connected to a lower surface of the table is movable relative to the ground level and is shifted along the ground level by an actuator engaging said first arm.

5. In a rotary printing machine according to claim 2, wherein the means for raising the table includes an actuator disposed therebeneath.

6. In a rotary printing machine according to claim 1, wherein the horizontal rails of the carriage means are mounted close to and under the operating position of the cylinder and the means to obtain relative vertical movement include each of the cylinder support elements being mounted on the upper surface by means for moving each of the cylinder supports vertically relative to the trolley.

7. In a rotary printing machine according to claim 6, wherein the means for moving include a threaded shaft and bearing arrangement.

8. In a rotary printing machine according to claim 1, wherein the means for holding and driving the cylinder includes two freely rotatable disks having a circumferential surface being mounted in the frame facing each other with the circumferential surface tapering toward the center of the frame, each end of the cylinders being provided with a concentric rim having an inner surface provided with a taper corresponding to the taper of said disk, the smallest diameter of the taper of said rings being smaller than the largest diameter of the taper of said disks, means mounting one disk in a fixed axial position, said one disk including a concentric pusher disposed on the axle of the one disk for engaging an end wall member of the cylinder and the other of said disks being mounted by an actuator providing axial movement thereof.

9. In a rotary printing machine according to claim 1, wherein at least one of the rails includes a rack with teeth and the corresponding end member of the trolley includes a dog actuated by means of a handle engaging one of the teeth of the rack to interlock the trolley in a given position.

10. In a rotary printing machine according to claim 1, wherein the horizontal rails of the carriage means are situated close to and under the operating position of said cylinder, said means for obtaining relative movement including the means for mounting having means for raising and lowering the ends of the rails directly beneath the cylinder.

11. In a rotary printing machine according to claim 1, wherein the frame of said machine includes cross members having means coacting with means on the workshop cart to position said cart with rails mounted on said cart being aligned with the rails of the printing machine to receive the trolley from the printing machine, said means for positioning including a pair of projections receivable in a pair of apertures.

12. In a rotary printing machine according to claim 1, wherein said trolley includes cylinder support elements for supporting two cylinders side-by-side.

13. In a rotary printing machine including a frame, holding and driving means for disengageably positioning an exchangeable cylinder in a cylinder operating position on an operating axis in the frame of the machine, the improvement comprising transfer means for moving a cylinder into and out of the frame, said transfer means including carriage means being positioned to transport a cylinder in a substantially horizontal plane in a direction extending perpendicular to the operating axis of the cylinder, said transfer means including means to obtain a relative movement in a vertical direction between the cylinder operating position and the carriage means to enable engagement of the cylinder while in the operating position by the carriage means, so that after engagement on the carriage means, the cylinder is released by the holding and driving means, and then is subsequently removed in said direction perpendicular to the operating axis, the machine frame including two side members interconnected by crossbars positioned below the operating position of the cylinder, said carriage means including two vertical members mounted on said crossbars adjacent the side frame members and facing each other, two horizontal bars secured on the ends of said two vertical members and protruding from the frame, each of said two horizontal bars being provided with a stop plate at each end, a horizontal crossbar member extending between said horizontal bars and said means for a relative vertical member including jack members secured to the means for holding and driving the cylinder for raising and lowering said cylinder relative to the carriage means, said transfer means including a workshop cart positioned at one end of the two horizontal bars to receive the cylinder engaged with the stop plate, said cart having means for lifting the cylinders off said horizontal bars.

14. In a rotary printing machine according to claim 13, wherein the means for holding and driving include a pair of disk members having a tapering outer circumference, said tapering outer circumference converging toward each other, one of said disk members being mounted for movement along its axis toward and away from the other member between an engagement position and a retracted position, each end of said cylinders being provided with a ring having an inner circumferential tapering surface, said tapering surface of the ring being matched to the tapering outer circumference of said disk with the inner diameter of the tapered surface of the ring being smaller than the smallest diameter of the tapering outer circumference of said disk, said other of said pair of disks including a concentric pusher disposed on the axis of the disk to enable disengaging the ring of a cylinder from said disk as the first of said disks is in a retracted position.

* * * * *